US007128809B2

(12) United States Patent
Vinson et al.

(10) Patent No.: US 7,128,809 B2
(45) Date of Patent: Oct. 31, 2006

(54) HIGH CALIPER WEB AND WEB-MAKING BELT FOR PRODUCING THE SAME

(75) Inventors: Kenneth Douglas Vinson, Cincinnati, OH (US); John Allen Manifold, Milan, IN (US); Jonathan Andrew Ficke, Lawrenceburg, IN (US); Yanping Zhang, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 159 days.

(21) Appl. No.: 10/288,036

(22) Filed: Nov. 5, 2002

(65) Prior Publication Data

US 2004/0084167 A1 May 6, 2004

(51) Int. Cl.
*D21F 1/10* (2006.01)
*B32B 3/10* (2006.01)

(52) U.S. Cl. ..... 162/348; 162/116; 162/903; 428/137; 428/196

(58) Field of Classification Search ..... 162/109–117, 162/348, 358.2, 358.4, 361, 362, 380, 900–903; 34/116, 123; 442/277, 281, 286; 428/131–138, 428/152–154, 170–172, 196
See application file for complete search history.

(56) References Cited

U.S. PATENT DOCUMENTS

| | | | | |
|---|---|---|---|---|
| 3,611,988 | A | 10/1971 | Hess | |
| 4,046,231 | A | 9/1977 | Ohori et al. | |
| 4,214,648 | A | 7/1980 | Kobayashi et al. | |
| 4,219,106 | A | 8/1980 | Lupertz et al. | |
| 4,498,564 | A | 2/1985 | Tamura | |
| 4,566,564 | A | 1/1986 | Bolenbaugh et al. | |
| 4,632,227 | A | 12/1986 | Mery et al. | |
| 4,784,242 | A | 11/1988 | Thioux | |
| 4,995,481 | A | 2/1991 | Temple et al. | |
| 5,083,641 | A | 1/1992 | Kleiva | |
| 5,297,659 | A | 3/1994 | Thiel et al. | |
| 5,334,289 | A * | 8/1994 | Trokhan et al. | 162/358.2 |
| 5,431,786 | A | 7/1995 | Rasch et al. | |
| 5,527,428 | A * | 6/1996 | Trokhan et al. | 162/116 |
| 5,551,537 | A | 9/1996 | Mery et al. | |

(Continued)

FOREIGN PATENT DOCUMENTS

WO WO 97/44528 11/1997

(Continued)

OTHER PUBLICATIONS

PCT International Search Report, PCT/US 03/35238, May 11, 2003.

*Primary Examiner*—Eric Hug
(74) *Attorney, Agent, or Firm*—Peter D. Meyer; David K. Mattheis

(57) ABSTRACT

A web-making fabric for producing a high caliper fibrous web and the fibrous web produced thereby. The web-making fabric comprises a reinforcing structure and a framework joined to the reinforcing structure. The framework defines a plurality of deflection conduits, at least one deflection conduit is a negatively radiused deflection conduit, and at least one deflection conduit is a positively radiused deflection conduit. The positively radiused deflection conduits are sized, shaped, and arranged to maximize fiber deflection along the periphery of the conduits. The web comprises three regions, a first region a second region and a third region. The first region is immediately adjacent to at least one of the second region and the third region. The second region comprises a plurality of negatively radiused domes. The third region comprises a plurality of positively radiused domes.

17 Claims, 6 Drawing Sheets

U.S. PATENT DOCUMENTS

| | | | | |
|---|---|---|---|---|
| 5,566,791 | A | 10/1996 | Ohishi | |
| 5,624,790 | A | 4/1997 | Trokhan et al. | |
| 5,679,222 | A | 10/1997 | Rasch et al. | |
| 5,714,041 | A | 2/1998 | Ayers et al. | |
| 6,030,690 | A | 2/2000 | McNeil et al. | |
| 6,039,155 | A | 3/2000 | Demoise, Jr. | |
| 6,117,270 | A | 9/2000 | Trokhan | |
| 6,171,447 | B1 * | 1/2001 | Trokhan | 162/358.2 |
| 6,286,636 | B1 | 9/2001 | Iwata | |
| 6,386,335 | B1 | 5/2002 | DiPonio | |
| 6,402,895 | B1 * | 6/2002 | Best | 162/358.2 |
| 6,420,100 | B1 | 7/2002 | Trokhan et al. | |
| 6,533,080 | B1 | 3/2003 | Miyata | |
| 6,576,091 | B1 * | 6/2003 | Cabell et al. | 162/348 |
| 6,821,385 | B1 * | 11/2004 | Burazin et al. | 162/109 |

FOREIGN PATENT DOCUMENTS

| | | |
|---|---|---|
| WO | WO 98/37274 | 8/1998 |
| WO | WO 02/41815 | 5/2002 |
| WO | WO 02/061191 | 8/2002 |

* cited by examiner

HIGH CALIPER WEB AND WEB-MAKING BELT FOR PRODUCING THE SAME

FIELD OF THE INVENTION

The present invention is related to web-making fabrics useful for making low density, soft, absorbent, fibrous web products and to the fibrous web products produced thereby. More particularly, this invention is concerned with web-making fabrics comprising a framework and a reinforcing structure and the high caliper/low density web products produced thereby.

BACKGROUND OF THE INVENTION

Cellulosic fibrous webs such as paper are well known in the art. Such fibrous webs are in common use today for paper towels, toilet tissue, facial tissue, napkins and the like. The large demand for such cellulosic fibrous web products has created a demand for improved versions of the products and the methods of their manufacture.

In order to meet the needs of the consumer, cellulosic fibrous webs must exhibit several characteristics. They must have sufficient tensile strength to prevent the structures from tearing or shredding during ordinary use or when relatively small tensile forces are applied. The cellulosic fibrous webs must be absorbent, so that liquids may be quickly absorbed and fully retained by the fibrous structure. Also, the web should exhibit softness, so that it is tactilely pleasant and not harsh during use.

Caliper is the apparent thickness of a cellulosic fibrous web measured under a certain mechanical pressure and is a function of basis weight and web structure. Strength, absorbency, and softness are influenced by the caliper of the cellulosic fibrous web.

Processes for the manufacturing of paper products generally involve the preparation of an aqueous slurry of cellulosic fibers and subsequent removal of water from the slurry while contemporaneously rearranging the fibers to form an embryonic web. After the initial forming, the fibrous web is carried through a drying process on another fabric referred to as the drying fabric which is in the form of an endless belt. During the drying process, the embryonic web may take on a specific pattern or shape caused by the arrangement and deflection of cellulosic fibers.

U.S. Pat. No. 4,529,480 issued to Trokhan on Jul. 16, 1985 introduced a web-making belt comprising a foraminous woven member which was joined to a hardened photosensitive resin framework. The resin framework was provided with a plurality of discrete, isolated channels known as deflection conduits. The utilization of the belt in the web-making process provided the possibility of creating fibrous web having certain desired characteristics of strength, absorption, and softness. Generally speaking, the webs produced with these web-making belts are characterized by having a high density knuckle region corresponding to the framework, and a plurality of relatively low density pillow regions or domes corresponding to the deflection conduits.

Once the drying phase of the web-making process is finished, the arrangement and deflection of fibers is complete. However, depending on the type of the finished product, fibrous web may go through additional processes such as calendering, softener application, and converting. These processes tend to compress the dome regions of the fibrous web and reduce the caliper. Thus, producing high caliper finished fibrous web products requires forming cellulosic fibrous structures having a resistance to compressive forces.

Accordingly, the present invention provides a web-making fabric that enables the formation of a high caliper fibrous structure that is resistant to compressive forces

SUMMARY OF THE INVENTION

A web-making fabric capable of producing a low density/high caliper web and the fibrous web produced thereby are disclosed. The web-making fabric comprises a reinforcing structure having a framework joined thereto. The framework defines a negatively radiused deflection conduit, and also defines a positively radiused deflection conduit. In one embodiment the framework forms a continuous network. In another embodiment the framework forms a semi-continuous network.

The fibrous web comprises a first region, a second region, and a third positively radiused region. In one embodiment the first region forms a continuous network immediately adjacent to at least one of the second region and the third region. In another embodiment the first region forms a semi-continuous network immediately adjacent to at least one of the second region and the third region. The second region comprises a plurality of negatively radiused domes. The third region comprises a plurality of positively radiused domes.

It will be understood that all patents referenced in this description are hereby incorporated herein by reference.

BRIEF DESCRIPTION OF THE DRAWING

These and other features, aspects and advantages of the present invention will become better understood with regard to the following description, appended claims, and accompanying drawings where:

DETAILED DESCRIPTION OF THE INVENTION

Definitions

Figure 1:
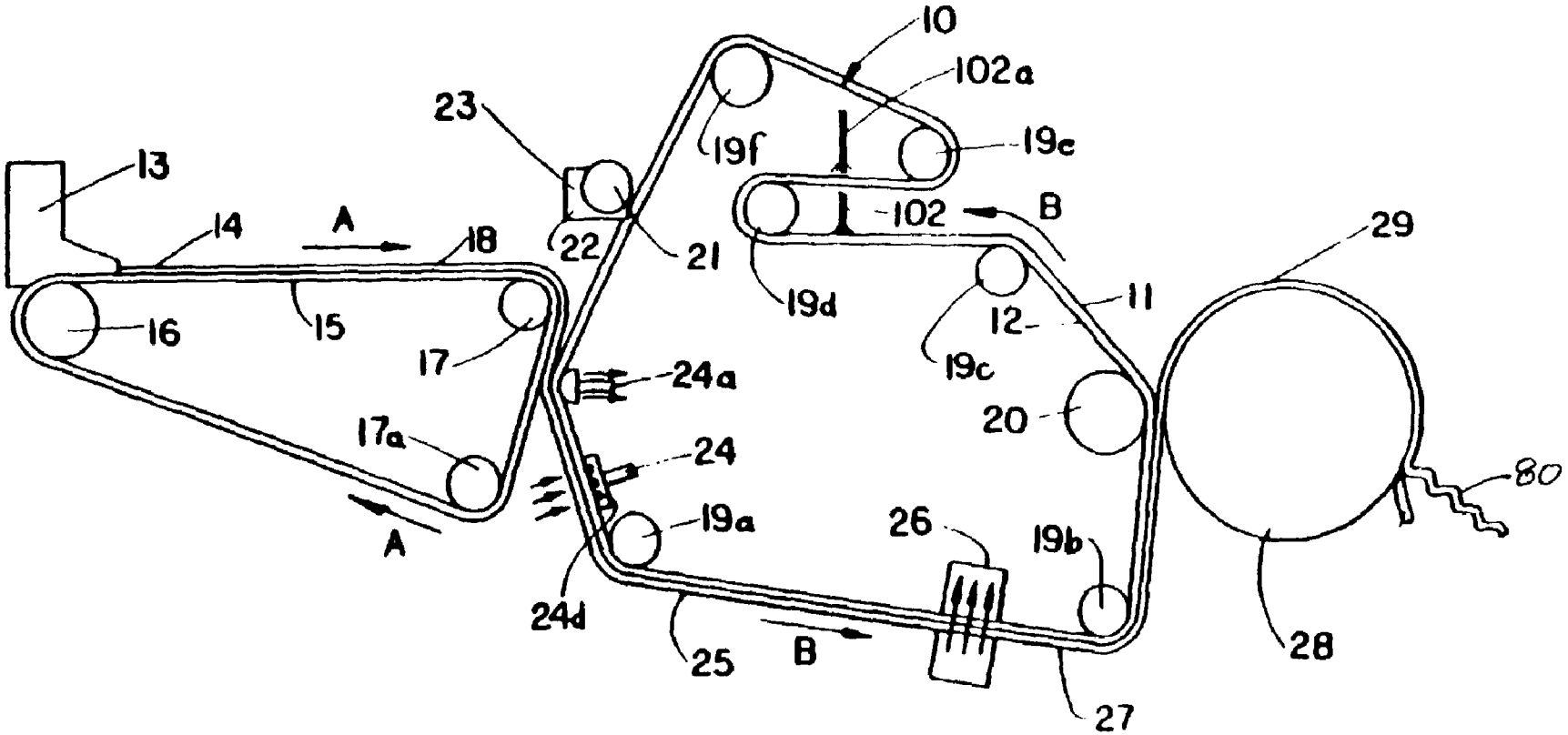
FIG. 1 is a schematic side elevational view of one embodiment of a web-making machine which uses the web-making belt of the present invention.

As used herein, the following terms have the following meanings:

Machine direction, designated MD, is the direction parallel to the flow of the fibrous web through the web-making equipment.

Cross machine direction, designated CD, is the direction perpendicular to the machine direction in the X-Y plane.

Center of area is a point within the deflection conduit that would coincide with the center of mass of a thin uniform distribution of matter bounded by the periphery of the deflection conduit.

Major axis is the longest axis crossing the center of area of the deflection conduit and joining two points along the perimeter of the deflection conduit.

Minor axis is the shortest axis or width crossing the center of area of the deflection conduit and joining two points along the perimeter of the deflection conduit. The minor axis corresponds to the minimum width of the deflection conduit.

Aspect Ratio is the ratio of the machine direction length of a deflection conduit to the cross machine direction length of a deflection conduit.

Mean width of the conduit is the average length of straight lines drawn through the center of area of the conduit and joining two points on the perimeter thereof.

Radius of curvature is the instantaneous radius of curvature at a point on a curve.

Infinite radius of curvature is the radius of curvature of a straight line in that the point of origin for a curve that yields a straight line must be an infinite distance from the line.

Negative radius is the radius of curvature of a periphery segment seen as a convex segment from the center of area.

Positive radius is the radius of a periphery segment seen as a concave segment from the center of area.

Positively radius deflection conduit or dome is a deflection conduit or dome having a periphery comprising concave or straight segments as seen from the center of area of the deflection conduit or dome, and optimized with respect to fiber deflection.

Negatively radiused deflection conduit or dome is a deflection conduit or dome having a periphery comprising convex or straight segments as seen from the center of area of the deflection conduit or dome, and non-optimized with respect to fiber deflection.

Curvilinear pertains to curved lines.

Rectilinear pertains to straight lines.

Z-direction height is the portion of the resin framework extending from the web facing side of the reinforcing structure.

Mean fiber length is the length weighted average fiber length of a fiber slurry or fibrous web.

Essentially Continuous network refers to a pattern in which one can connect any two points on or within that pattern by an uninterrupted line running entirely on or within that pattern throughout the line's length. The network is essentially continuous in that minor deviation in the continuity of the network may be tolerated as long as the minor deviations to not significantly affect the performance of the fabric.

Essentially Semi-continuous network refers to a pattern which has "continuity" in all, but at least one, directions parallel to the X-Y plane, and in which pattern one cannot connect any two points on or within that pattern by an uninterrupted line running entirely on or within that pattern throughout the line's length. Of course, the semi-continuous pattern may have continuity only in one direction parallel to the X-Y plane. The network is essentially semi-continuous in that minor deviation in the semi-continuity of the network may be tolerated as long as the minor deviations to not significantly affect the performance of the fabric.

The specification contains a detailed description of (1) the web-making fabric of the present invention and (2) the finished web product of the present invention. Although the description is provided in terms of a papermaking belt and a finished paper product, those of skill in the art will understand that the invention is not so limited and may be applied to the manufacture of any wet laid fibrous web material.

(1) The Web making Fabric

In the representative papermaking machine schematically illustrated in FIG. 1, the web-making fabric of the present invention takes the form of an endless belt, papermaking belt 10. The papermaking belt 10 has a paper-contacting side 11 and a backside 12 opposite the paper-contacting side 11. The papermaking belt 10 carries a paper web (or "fiber web") in various stages of its formation (an embryonic web 27 and an intermediate web 29). Processes of forming embryonic webs are described in many references, such as U.S. Pat. No. 3,301,746, issued to Sanford and Sisson on Jan. 31, 1974, and U.S. Pat. No. 3,994,771, issued to Morgan and Rich on Nov. 30, 1976. The papermaking belt 10 travels in the direction indicated by directional arrow B around the return rolls 19*a* and 19*b*, impression nip roll 20, return rolls 19*c*, 19*d*, 19*e*, 19*f*, and emulsion distributing roll 21. The loop around which the papermaking belt 10 travels includes a means for applying a fluid pressure differential to the embryonic web 27, such as vacuum pickup shoe (PUS) 24*a* and multi-slot vacuum box 24. In FIG. 1, the papermaking belt 10 also travels around a predryer such as blow-through dryer 26, and passes between a nip formed by the impression nip roll 20 and a Yankee drying drum 28.

Although the illustrated embodiment of the papermaking belt of the present invention is in the form of an endless belt 10, it can be incorporated into numerous other forms which include, for instance, stationary plates for use in making handsheets or rotating drums for use with other types of continuous process. Regardless of the physical form which the papermaking belt 10 takes for the execution of the claimed invention, it generally has certain physical characteristics set forth below.

Figure 2:
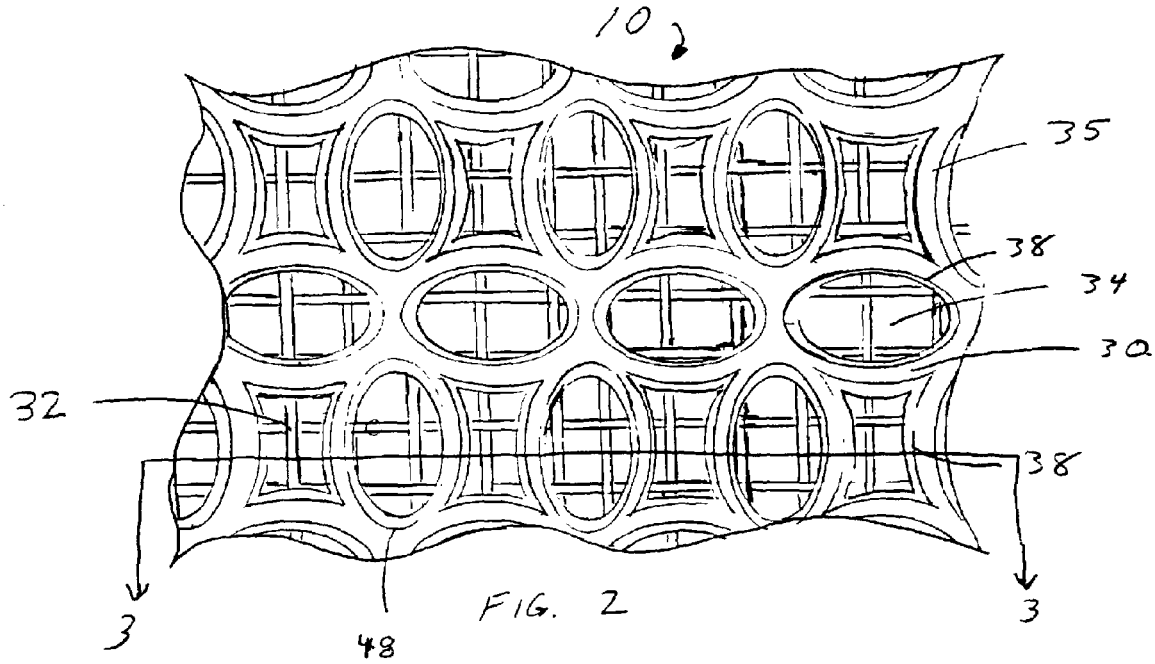
FIG. 2 is a top plan view of a portion of the web-making fabric of the present invention, showing the framework joined to the reinforcing structure and having negatively radiused deflection conduits and positively radiused deflection conduits.

As shown in FIG. 2, the belt 10 according to the present invention comprises two primary components: a framework 30 and a reinforcing structure 32. In one embodiment the framework 30 comprises a cured polymeric resin. The framework 30 and belt 10 have a first surface 111 which defines the paper contacting side 111 of the belt 10 and an opposed second surface 12 oriented towards the papermaking machine on which the papermaking belt 10 is used.

As used herein, X, Y and Z directions are orientations relating to the papermaking making belt 10 of the present invention (or paper web 27 disposed on the belt) in a Cartesian coordinate system. The papermaking belt 10 according to the present invention is macroscopically monoplanar. Macroscopically monoplanar means that the overall impression invoked is that of a plane. A macroscopically monoplanar element may also comprise nonplanar three dimensional details to the extent that the details do not significantly detract from the macroscopically monoplanar impression invoked by the element. The plane of the papermaking belt 10 defines its X-Y directions. Perpendicular to the X-Y directions and the plane of the papermaking belt 10 is the Z-direction of the belt 10. Likewise, the web 27 according to the present invention can be thought of as macroscopically monoplanar and lying in an X-Y plane. Perpendicular to the X-Y directions and the plane of the web 27 is the Z-direction of the web 27.

In one embodiment the framework 30 defines a predetermined pattern and provides a knuckle area 36 which imprints a like pattern onto the web 27 of the present invention. One pattern for the framework 30 is an essentially continuous network. If the essentially continuous network pattern is selected for the framework 30, discrete positively radiused deflection conduits 34 and discrete negatively radiused deflection conduits 35 will extend between the first surface 11 and the second surface 12 of the belt 10. The essentially continuous network surrounds and defines the positively radiused deflection conduits 34 and negatively radiused deflection conduits 35. In another embodiment illustrated in FIG. 5, the framework 30 is an essentially semi-continuous network defining discrete positively radiused deflection conduits 34 and semi-continuous negatively radiused deflection conduits 35.

Imprinting occurs anytime the belt 10 and web 27 pass between two rigid surfaces having a clearance sufficient to cause imprinting. This generally occurs in a nip between two rolls and most commonly occurs when the belt 10 transfers the paper to a Yankee drying drum 28. Imprinting is caused by compression of the framework 30 against the paper 27 at the pressure roll 20.

The second machine contacting surface may be made with a backside network having passageways therein which are distinct from the positively radiused deflection conduits 34 and negatively radiused deflection conduits 35. The passageways provide irregularities in the texture of the backside of the second surface 12 of the belt 10. The irregularities allow for air leakage in the X-Y plane of the belt 10, which leakage does not necessarily flow in the Z-direction through the deflection conduits 34 of the belt 10.

The second primary component of the belt 10 according to the present invention is the reinforcing structure 32. The reinforcing structure 32, like the framework 30, has a first or paper facing surface 13 and a second or machine facing surface 12 opposite the paper facing surface. The reinforcing structure 32 is primarily disposed between the opposed surfaces of the belt 10 and may have a surface coincident the backside of the belt 10. The reinforcing structure 32 provides support for the framework 30. The reinforcing component is typically woven, as is well known in the art. The portions of the reinforcing structure 32 registered with the positively radiused deflection conduits 34 and negatively radiused deflection conduits 35 prevent fibers used in papermaking from passing completely through the positively radiused deflection conduits 34 and negatively radiused deflection conduits 35 and thereby reduces the occurrences of pinholes. If one does not wish to use a woven fabric for the reinforcing structure 32, a nonwoven element, screen, net, or a plate having a plurality of holes therethrough may provide adequate strength and support for the framework 30 of the present invention.

Figure 3:
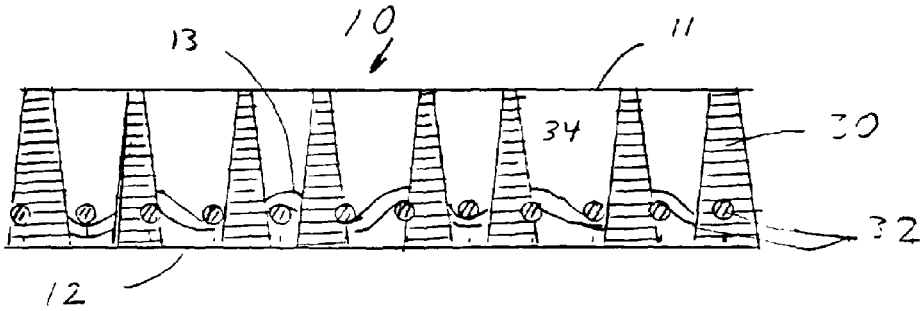
FIG. 3 is a vertical cross-sectional view of a portion of the web-making fabric shown in FIG. 2 as taken along line 3—3.

As shown in FIG. 3, the framework 30 is joined to the reinforcing structure 32. The framework 30 extends outwardly from the paper-facing side 13 of the reinforcing structure 32. The reinforcing structure 32 strengthens the resin framework 30 and has suitable projected open area to allow the vacuum dewatering machinery employed in the papermaking process to perform adequately its function of removing water from the embryonic web 27, and to permit water removed from the embryonic web 27 to pass through the papermaking belt 10.

The belt 10 and web 80 according to the present invention may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 4,637,859, issued Jan. 20, 1987 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,364,504 issued Nov. 15, 1994 to Smurkoski et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,529,664, issued Jun. 25, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876 issued May 13, 1997 to Ayers et al.; U.S. Pat. No. 5,679,222 issued Oct. 21, 1997 to Rasch et al.; and U.S. Pat. No. 5,714,041 issued Feb. 3, 1998 to Ayers et al.

The ability to produce a paper web 27 having a particular thickness requires control of the caliper of the web 27. Caliper is the apparent thickness of a cellulosic fibrous web measured under a certain mechanical pressure. Caliper is a function of web basis weight, web density, and web structure. Basis weight is the weight in pounds of 3000 square feet of paper. Web structure pertains to orientation and density of fibers making up the web 27.

Fibers comprising the web 27 are typically oriented in the X-Y plane and provide minimal structural support in the Z-direction. Thus, as the web 27 is compressed by the framework 30, the web 27 is compacted creating a patterned, high density "knuckle" region that is reduced in thickness. Conversely, portions of the web 27 covering the positively radiused deflection conduits 34 and negatively radiused deflection conduits 35 are not compacted and as a result, thicker, low density "pillow" regions or domes are produced.

Positively radiused deflection conduits 34 and negatively radiused deflection conduits 35 provide a means for deflecting fibers in the Z-direction along the periphery 38. Fiber deflection produces a fiber orientation which includes a Z-direction component. Such fiber orientation not only creates web caliper but also provides a certain amount of structural rigidity in the Z-direction which assists the web 27 in sustaining its caliper throughout the papermaking process. Accordingly, for the present invention, positively radiused deflection conduits 34 are sized, shaped, and oriented to maximize fiber deflection along the periphery 38.

The positively radiused deflection conduits 34 are optimally sized according to the mean fiber length of the slurry used to form the web 27. For optimal deflection the minimum width of the positively radiused deflection conduit 34 should be equal to or greater than the mean fiber length of the slurry.

As the mean fiber length in the machine direction tends to be greater than the mean fiber length in the cross direction, positively radiused deflection conduits 34 oriented more in the machine direction are provide for optimal deflection. The shape and orientation of the positively radiused deflection conduits 34 is defined by an aspect ratio, or the ratio of the width of the positively radiused deflection conduit 34 in the machine direction to the width of the positively radiused deflection conduit 34 in the cross machine direction.

For optimal deflection the aspect ratio should be equal to the ratio of the mean fiber length in the machine direction to the mean fiber length in the cross machine direction. This ratio is proportional to the ratio of the tensile strength of the web in the machine direction to the tensile strength of the web in the cross machine direction. For optimal deflection the aspect ratio should be between about 1 and about 2. More specifically, the aspect ratio should be between about 1.2 and about 1.8. Still more specifically, the aspect ratio should be between about 1.4 and about 1.6.

The tensile strengths of the web 80 in MD and CD were measured using a Thwing-Albert Intelect II Standard Tensile Tester manufactured by Thwing-Albert Instrument Co. of Philadelphia, Pa.

Figure 9:
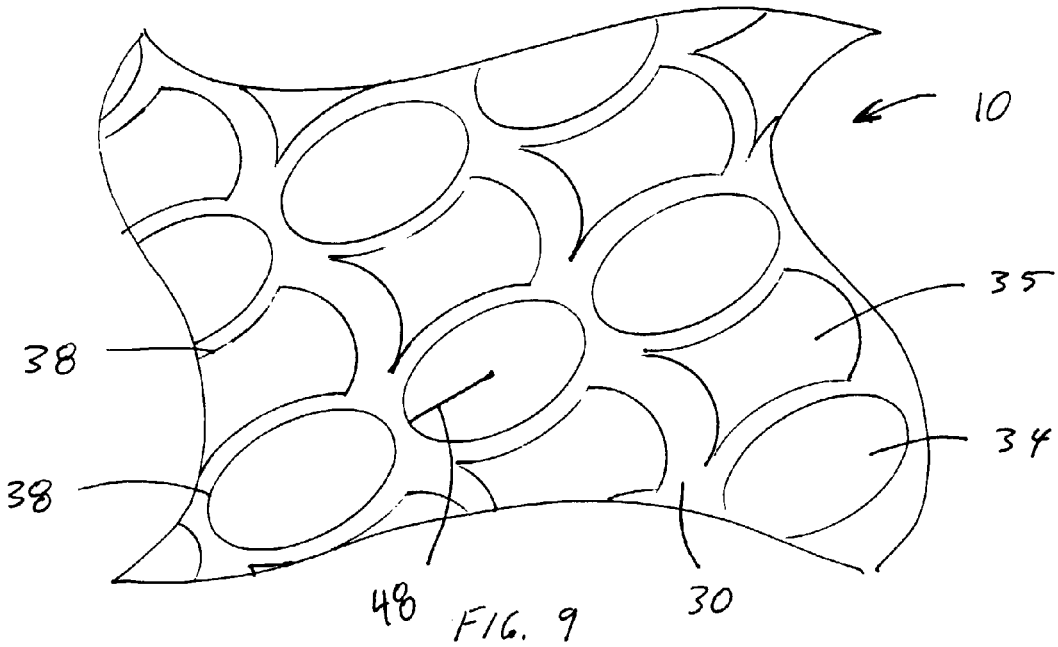
FIG. 9 is a schematic plan view of the web support framework of an alternative embodiment of the web-making fabric of the present invention.

A positively radiused deflection conduit 34 with a periphery 38 comprised of straight segments, concave segments—as seen from the center of area—and no sharp corners, is preferable for optimal deflection. Sharp corners are defined as junctions between peripheral segments having an angle of intersection less than 120 degrees. The positively radiused deflection conduit 34 has a minimum radius of curvature 48 (as shown in FIG. 9) corresponding to that portion of the periphery 38 having the smallest magnitude for the instantaneous radius of curvature. For optimal deflection, the ratio of the minimum radius of curvature 48 to the mean width should be at least about 0.2 and no greater than about 0.5. Positively radiused deflection conduit shapes include but are not limited to: circles, ovals, and polygons of six or more sides.

The dimensional stability of the web 80 is improved by altering the pattern of the deflection conduits defined by the framework 30. A framework 30 wherein at least about 10% of the total deflection conduit area comprises negatively radiused deflection conduits 35 yields paper webs 80 having greater dimensional stability than a framework 30 comprised only of optimized positively radiused deflection conduits 34. At equivalent basis weights, the framework 30 comprising both positively radiused deflection conduits 34 and negatively radiused deflection conduits 35 yields a web 80 having equivalent caliper and density to a web produced using a framework comprised of only optimized positively radiused deflection conduits 34. Up to about 90% of the total deflection conduit area may be comprised of negatively radiused deflection conduits. In the embodiment of the papermaking belt illustrated in FIG. 2, the cumulative area of the negatively radiused deflection conduits 35 comprise about 25% of the total area of all deflection conduits.

Figure 5:
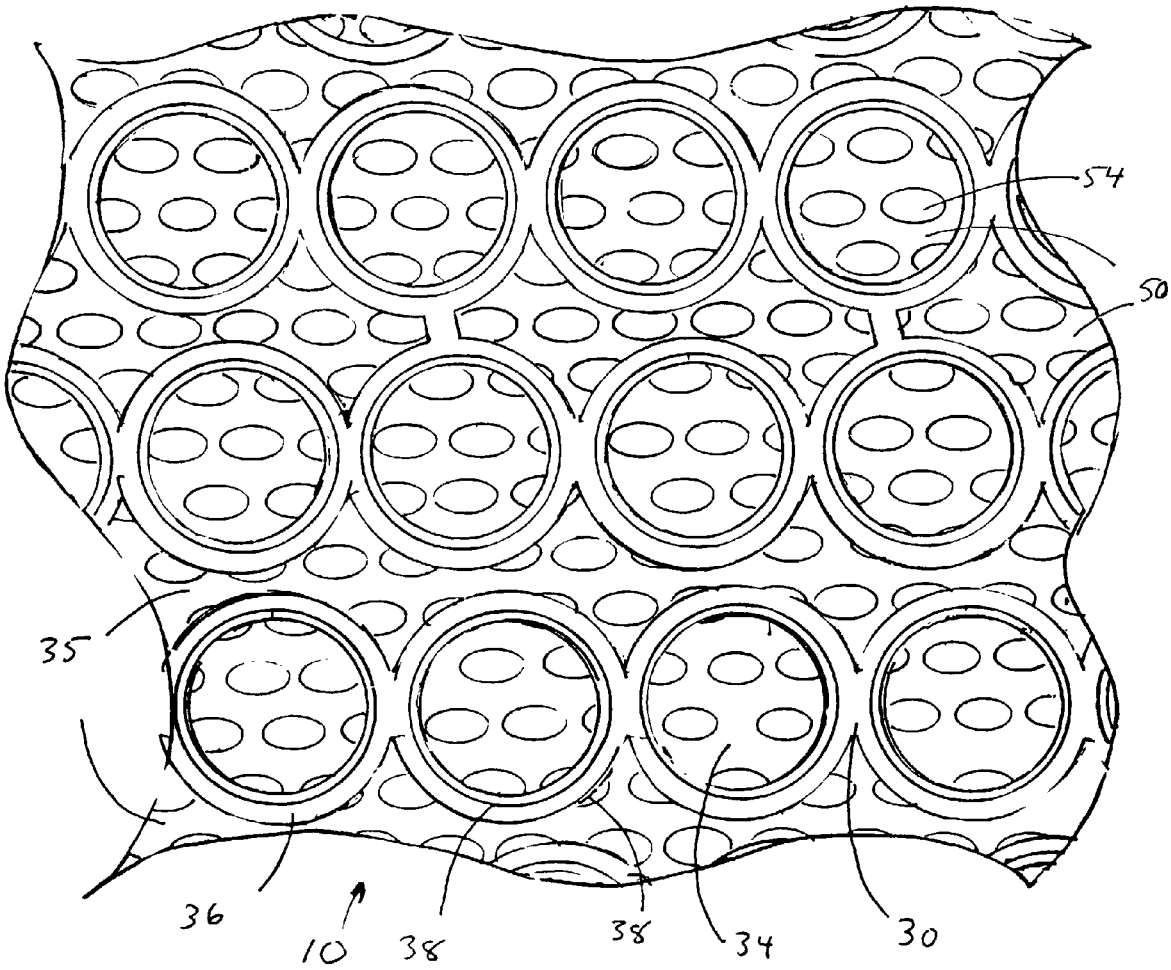
FIG. 5 is a schematic plan view of the web support framework of an alternative embodiment of the web-making fabric of the present invention.
Figure 6:
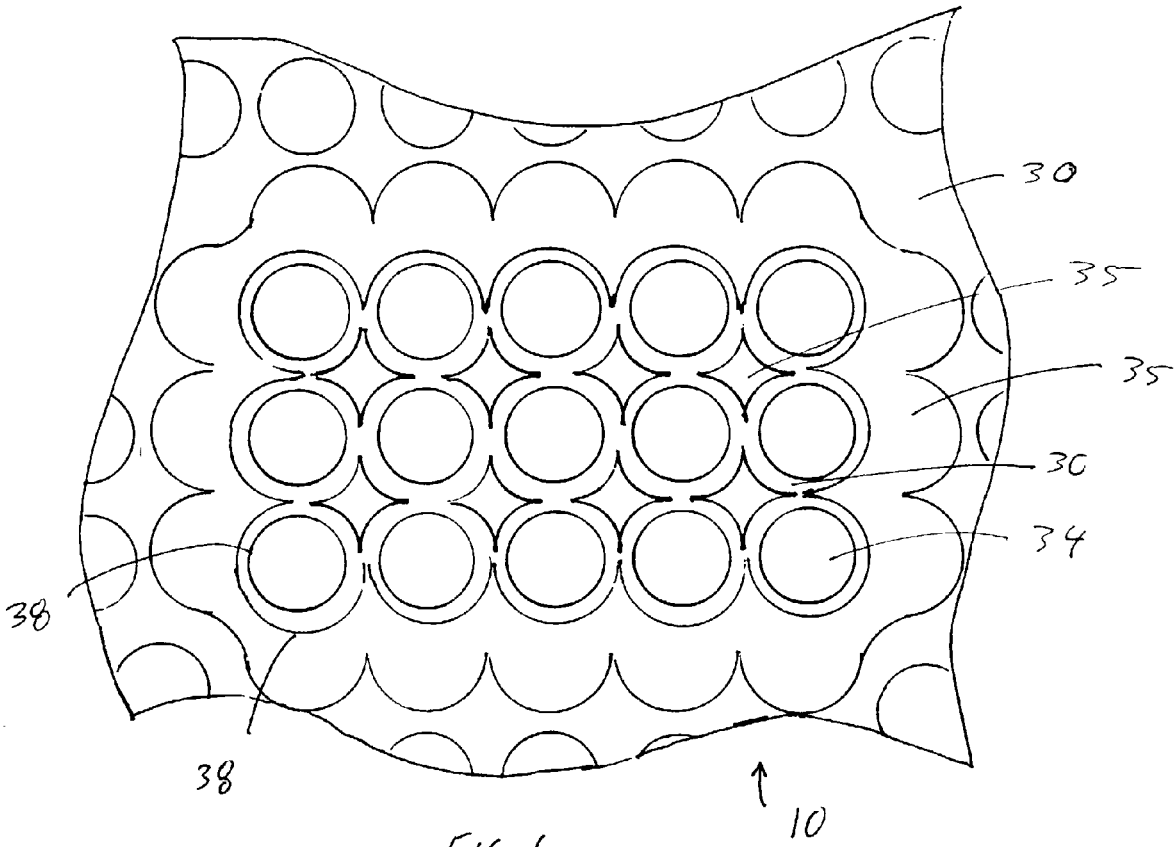
FIG. 6 is a schematic plan view of the web support framework of an alternative embodiment of the web-making fabric of the present invention.
Figure 7:
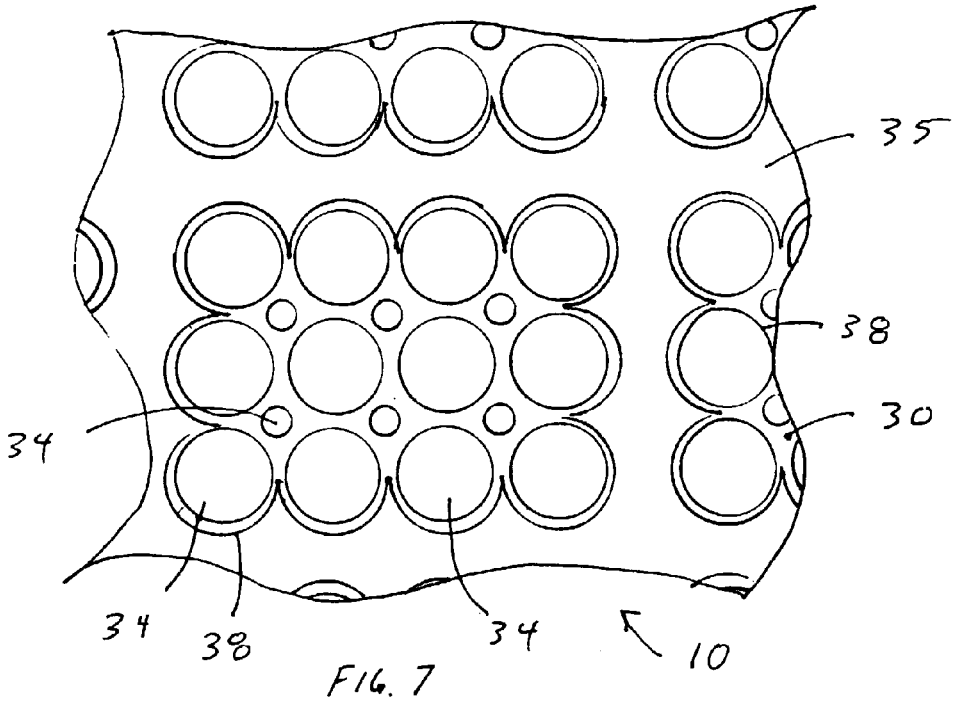
FIG. 7 is a schematic plan view of the web support framework of an alternative embodiment of the web-making fabric of the present invention.
Figure 8:
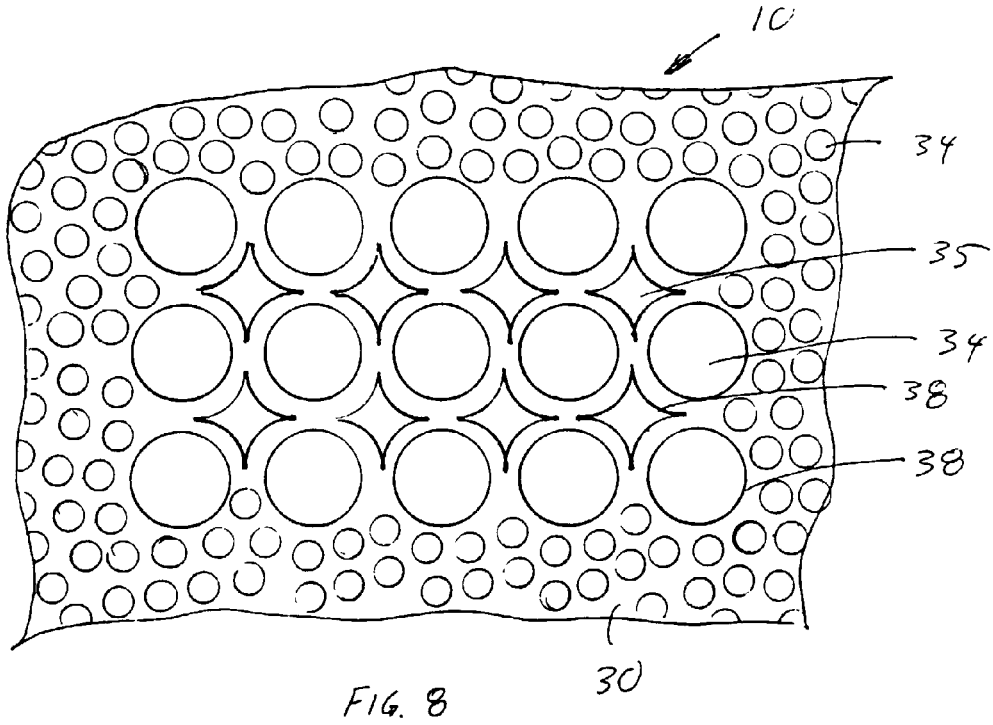
FIG. 8 is a schematic plan view of the web support framework of an alternative embodiment of the web-making fabric of the present invention.

The negatively radiused deflection conduits 35 and the positively radiused deflection conduits 34 may be interspersed with one another as shown in FIG. 2 and FIG. 5 or may be disposed in alternative patterns. Non-limiting examples of these patterns include: areas of positively radiused deflection conduits 34, separated by areas of negatively radiused deflection conduits 35, FIG. 5; areas of a combination of positively radiused deflection conduits 34 and negatively radiused deflection conduits 35, separated by areas of exclusively positively radiused deflection conduits 34, FIG. 8, or exclusively of negatively radiused deflection conduits 35 FIG. 6; areas of exclusively positively radiused deflection conduits 34 circumscribed by large negatively radiused deflection conduits 35 FIG. 7.

A negatively radiused deflection conduit 35 provides less deflection due to increased fiber bridging across the relatively short spans presented at the convergence of the convex segments. In one embodiment the negatively radiused deflection conduits 35 comprise a periphery 38 of straight segments intersecting at angles of less than 120 degrees. In another embodiment at least about 20% of the periphery 38 of the negatively radiused deflection conduits 35 has a negative radius. More specifically, at least about 40% of the periphery 38 of the negatively radiused deflection conduits 35 has a negative radius. Still more specifically, at least about 80% of the periphery 38 of the negatively radiused deflection conduits 35 has a negative radius. Still more specifically, the periphery 38 of the negatively radiused deflection conduits 35 may be comprised entirely of negative radiused segments. In one embodiment the periphery of the negatively radiused deflection conduits comprises no segments having a positive radius. In another embodiment FIG. 9, a portion of the periphery 38 of a negatively radiused deflection conduit 35 may have a positive radius. In another embodiment, up to about 30% of the periphery of the negatively radiused deflection conduits may have a positive radius.

In another embodiment the papermaking belt 10, further comprises a plurality of frameworks joined to the reinforcing structure 32. In one embodiment illustrated in FIG. 5, a second framework 50 comprises a nonrandom repeating pattern defining a plurality of deflection conduits 54. The average area of the deflection conduits 54 is less than or equal to the larger of the positively radiused deflection conduits 34 or the negatively radiused deflection conduits 35.

The second framework 50 provides support for fibers that are deflected into the positively radiused deflection conduits 34 and the negatively radiused deflection conduits 35. The deflection conduits 54 enable additional deflection of those fibers. In this way it is possible to impart additional caliper to the web 27 while also providing a high degree of fiber support. The second framework 50 may form an essentially continuous network, an essentially semi-continuous network, or a pattern of discrete shapes. The first framework 30 is joined to at least one of the second framework 50 and the reinforcing structure 32.

The Web

Figure 4:
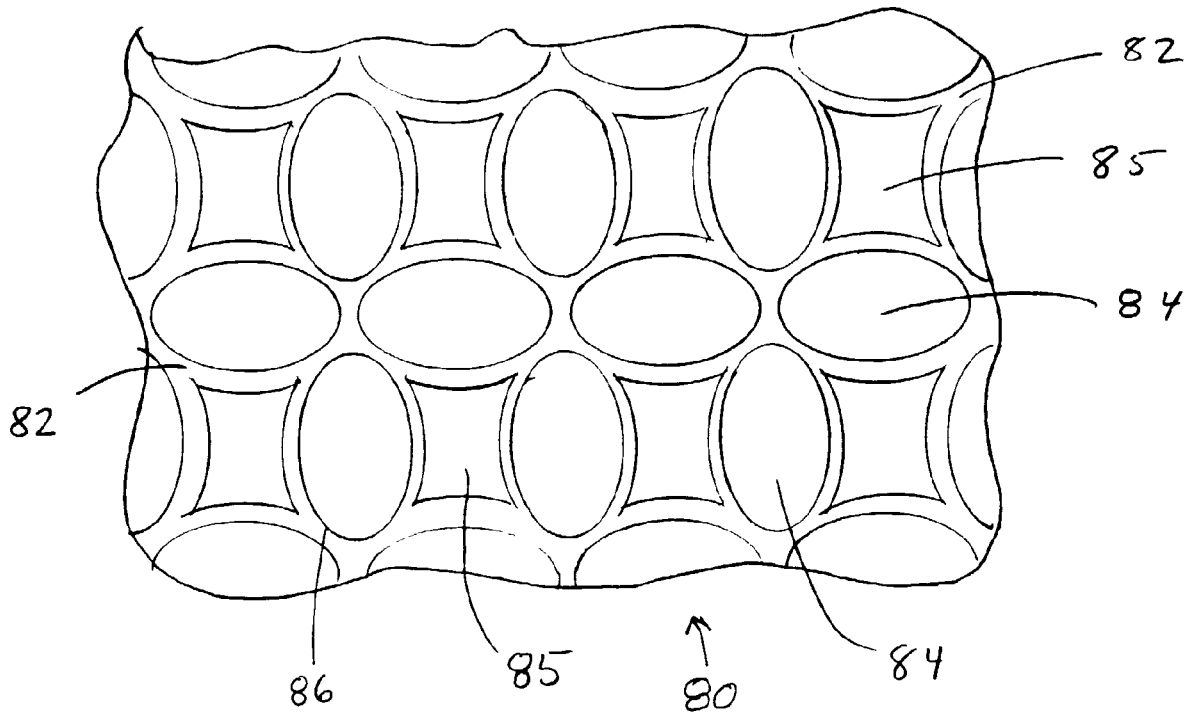
FIG. 4 is a schematic plan view of one embodiment of a fibrous web according to the present invention.

The web 80 of the present invention illustrated in FIG. 4 has three primary regions. The first region comprises an imprinted region 82 which is imprinted against the framework 30 of the belt 10. In one embodiment the imprinted region 82 comprises an essentially continuous network. The continuous network of the first region 82 of the web 80 is made on the essentially continuous framework 30 of the belt 10 and generally corresponds in geometry, and during papermaking in position, to the framework 30. The imprinted first region 82 may alternatively comprise an essentially semi-continuous network corresponding to a semi-continuous framework 30 as illustrated in FIG. 5.

The second region of the web 80 comprises a plurality of negatively radiused domes 85 dispersed throughout the imprinted network first region 82. The negatively radiused domes 85 generally correspond in geometry, and during papermaking in position, to the negatively radiused deflection conduits 35 in the belt 10. By conforming to the negatively radiused deflection conduits 35 during the papermaking process, the fibers in the negatively radiused domes 85 are deflected in the Z-direction between the paper facing surface of the framework 30 and the paper facing surface of the reinforcing structure 32. As a result, the negatively radiused domes 85 protrude outwardly from the essentially continuous network region 82 of the web 80. In one embodiment the negatively radiused domes 85 are discrete, isolated one from another by the continuous network region 82.

The third region of the web 80 comprises a plurality of positively radiused domes 84 dispersed throughout the imprinted network region 82. The positively radiused domes 84 generally correspond in geometry, and during papermaking in position, to the positively radiused deflection conduits 34 in the belt 10. By conforming to the positively radiused deflection conduits 34 during the papermaking process, the fibers in the positively radiused domes 84 are deflected in the Z-direction between the web facing surface of the framework 30 and the web facing surface of the reinforcing structure 32. As a result, the positively radiused domes 84 protrude outwardly from the essentially continuous network region 82 of the web 80. In one embodiment the positively radiused domes 84 are discrete, isolated one from another by the continuous network region 82. The positively radiused domes 84 have aspect ratios and minimum radii of curvature essentially the same as the positively radiused deflection conduits 34.

The first region 82 is immediately adjacent to at least one of the negatively radiused domes 85 and the positively radiused domes 84. By immediately adjacent it is meant that no other region is positioned between the two immediately adjacent regions. Without being bound by theory, it is believed the positively radiused domes 84, the negatively radiused domes 85, and the first regions 82, of the web 80, may have generally equivalent basis weights. By deflecting the positively radiused domes 84 into the positively radiused deflection conduits 34, the density of the positively radiused domes 84 is decreased relative to the density of the first region 82. By deflecting the negatively radiused domes 85 into the negatively radiused deflection conduits 35, the density of the negatively radiused domes 85 is decreased relative to the density of the first region 82.

The pattern of the first region, second region, and third region will emulate the pattern of the papermaking belt as described above.

The positively radiused deflection conduits 34 are optimized for fiber deflection relative to the negatively radiused deflection conduits 35. The positively radiused domes 84 will tend to deflect further into the positively radiused deflection conduits 34 than do the negatively radiused domes 85 into the negatively radiused deflection conduits 35. Therefore the positively radiused domes 84 will protrude further in the Z direction than do the negatively radiused domes 85. The negatively radiused domes 85 will protrude further in the Z direction than the first region 82.

Moreover, the first region 82 may later be imprinted as, for example, against a Yankee drying drum. Such imprinting increases the density of the first region 82 relative to that of the positively radiused domes 84 and relative to the negatively radiused domes 85. The resulting web 80 may be later embossed as is well known in the art.

The shapes of the domes 84 in the X-Y plane include, but are not limited to, circles, ovals, and polygons of six or more sides. In one embodiment, the domes 84 are generally elliptical in shape comprising either curvilinear or rectilinear peripheries 86. The curvilinear periphery 86 comprises a minimum radius of curvature such that the ratio of the minimum radius of curvature to mean width of the dome ranges from at least about 0.2 to about 0.5. The rectilinear periphery 86 may comprise of a number of wall segments where the included angle between adjacent wall segments is at least about 120 degrees.

The caliper of the web is typically measured under a pressure of 95 grams per square inch using a round presser foot having a diameter of 2 inches, after a dwell time of 3 seconds. The caliper can be measured using a Thwing-Albert Thickness Tester Model 89-100, manufactured by the Thwing-Albert Instrument Company of Philadelphia, Pa. The caliper is measured under TAPPI temperature and humidity conditions.

For the present invention, the caliper was measured on a web comprising two plies. In one embodiment the caliper of the two ply web is between 20 mils and 40 mils. In another embodiment the caliper of the two ply web is between 38 mils and 46 mils. In another embodiment the caliper of the two ply web is between 25 mils and 30 mils.

The web 80 of the invention may be a single ply web or may be one ply of a multiple ply web. A multiple ply embodiment may be comprised of multiple plies of web 80 or of a single ply of web 80 and other plies as are known in the art.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A fluid permeable web-making fabric having a web contacting surface for carrying a web of fibers, the web-making fabric comprising:

a reinforcing structure;

a framework joined to the reinforcing structure and defining a plurality of deflection conduits, the framework comprising a continuous network;

wherein the plurality of deflection conduits comprises at least one negatively radiused deflection conduit, and at least one positively radiused deflection conduit.

2. The web-making fabric of claim 1 wherein the positively radiused deflection conduit has an aspect ratio of from about 1 to about 2.

3. The web-making fabric of claim 1, wherein the positively radiused deflection conduit has a mean width and a minimum radius of curvature, and wherein a ratio of the minimum radius of curvature to the mean width is at least about 0.2 and no greater than about 0.5.

4. The web-making fabric of claim 1, wherein the negatively radiused deflection conduit has a first area and the positively radiused deflection conduit has a second area, and wherein a ratio of the first area to the second area is at least about 10% and no greater than about 90%.

5. The web-making fabric of claim 1, wherein the negatively radiused deflection conduit has a periphery, and wherein at least about 20% of the periphery has a negative radius.

6. The web-making fabric of claim 1 wherein the framework defines a plurality of negatively radiused deflection conduits and the framework defines a plurality of positively radiused deflection conduits.

7. A web-making fabric comprising:

a reinforcing structure;

a plurality of frameworks, the plurality comprising at least:

a first framework joined to the reinforcing structure; and a second framework joined to at least one of the first framework and the reinforcing structure;

wherein the first framework is disposed in a nonrandom repeating pattern selected from the group consisting of: an essentially continuous network pattern, an essentially semi-continuous network pattern, an essentially discrete pattern, and any combination of the above patterns, and wherein the second framework defines a plurality of deflection conduits, and the plurality of deflection conduits comprises at least one positively radiused deflection conduit and at least one negatively radiused deflection conduit, the plurality of deflection conduits being disposed in a nonrandom repeating pattern selected from the group consisting of: an essentially continuous network pattern, an essentially semi-continuous network pattern, and any combination of the above patterns.

8. A fluid permeable web-making fabric having a web contacting surface for carrying a web of fibers, the web-making fabric comprising:

a reinforcing structure;

a framework joined to the reinforcing structure defining a plurality of deflection conduits, the framework comprising a semi-continuous network; and, wherein the plurality of deflection conduits comprises at least one negatively radiused deflection conduit and at least one positively radiused deflection conduit.

9. The fluid permeable web making fabric of claim 8, further comprising a plurality of frameworks joined to the reinforcing structure.

10. The fluid permeable web making fabric of claim 9, wherein a second framework of said plurality of frameworks comprises a non-random repeating pattern.

11. The fluid permeable web making fabric of claim 8, wherein the positively radiused deflection conduit has an aspect ratio ranging from about 1 to about 2.

12. The fluid permeable web making fabric of claim 8, wherein the negatively radiused deflection conduit has a first area and a positively radiused deflection conduit as a second area, and wherein the ratio of the first area to the second area ranges from about 10 percent to no greater than about 90 percent.

13. A fluid permeable web making fabric having a web contacting surface for carrying a web of fibers, the web making fabric comprising:

a reinforcing structure;

a framework joined to the reinforcing structure and defining a plurality of deflection conduits;

wherein the plurality of deflection conduits comprises at least one negatively radiused deflection conduit and at least one positively radiused deflection conduit; and, wherein the negatively radiused deflection conduit has a first area and a positively radiused deflection conduit has a second area and wherein a ratio of the first area to the second area ranges from at least about 10 percent to about ninety percent.

14. The fluid permeable web making fabric of claim 13, wherein the framework comprises a continuous network.

15. The fluid permeable web making fabric of claim 13, wherein the framework comprises a semi-continuous network.

16. The fluid permeable web making fabric of claim 13, wherein the framework defines a plurality of negatively radiused deflection conduits and the framework defines a plurality of positively radiused deflection conduits.

17. The fluid permeable web making fabric of claim 13, further comprising a plurality of frameworks joined to the reinforcing structure.

* * * * *